US006785466B1

(12) United States Patent
Jackson et al.

(10) Patent No.: US 6,785,466 B1
(45) Date of Patent: Aug. 31, 2004

(54) ELECTRIC WATER HEATER HAVING BALANCED WATTAGE DENSITY WATER HEATING

(75) Inventors: Barry N. Jackson, Woodbury, MN (US); Gary W. Gauer, Cottage Grove, MN (US); Jeffrey A. Leep, Wetumpka, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/667,048

(22) Filed: Sep. 22, 2003

(51) Int. Cl.[7] ..... F24H 1/20
(52) U.S. Cl. ..... 392/454; 392/450
(58) Field of Search ..... 392/441–449, 392/450, 451, 454

(56) References Cited

U.S. PATENT DOCUMENTS

| | | | | |
|---|---|---|---|---|
| 1,892,557 A | | 12/1932 | McCormick | |
| 2,157,910 A | | 5/1939 | McCormick | 219/39 |
| 2,712,052 A | | 6/1955 | Buehne | 219/38 |
| 2,834,865 A | | 5/1958 | Coates | 219/38 |
| 3,352,999 A | | 11/1967 | Macoicz et al. | 219/321 |
| 3,465,123 A | | 9/1969 | Harris | 219/328 |
| 4,058,702 A | | 11/1977 | Jerles | 219/321 |
| 4,638,147 A | | 1/1987 | Dytch et al. | 219/308 |
| 4,948,948 A | * | 8/1990 | Lesage | 392/454 |
| 5,968,393 A | | 10/1999 | Demaline | 219/492 |
| 6,246,831 B1 | | 6/2001 | Seitz et al. | 392/486 |
| 6,370,328 B1 | | 4/2002 | Mottershead | 392/452 |
| 6,633,726 B2 | * | 10/2003 | Bradenbaugh | 392/463 |

FOREIGN PATENT DOCUMENTS

| | | | |
|---|---|---|---|
| FR | 561804 | * | 2/1923 |

* cited by examiner

*Primary Examiner*—Thor S. Campbell
(74) *Attorney, Agent, or Firm*—Konneker & Smith, P.C.

(57) ABSTRACT

An electric water heater has a tank portion in which water to be heated is stored. The stored water is heated by a vertically spaced plurality of electric heating elements extending into the tank interior. The heating elements are of unequal wattages, and serve unequal volume water zones, but provide equal heating wattage densities in each of the water zones.

15 Claims, 1 Drawing Sheet

ELECTRIC WATER HEATER HAVING BALANCED WATTAGE DENSITY WATER HEATING

BACKGROUND OF THE INVENTION

The present invention generally relates to liquid heating devices and, in a preferred embodiment thereof, more particularly relates to an electric water heater having a heating system providing, throughout the tank portion of the heater, equal heating wattage density for unequal volume water zones utilizing unequal wattage electric heating structures.

Conventional residential type electric water heaters are typically is provided with two electric heating elements projecting into their water storage tank portion—one element being mounted near the bottom of the tank, and the other element being mounted near the top of the tank. The top electrical heating element is designed to heat a small amount of water so that when the water heater is first installed, or when most of the hot water in the tank has been used, a limited amount of hot water is available. This provides at least some utility while the complete volume of tank water is heating.

Conventional commercial type electric water heaters, on the other hand, are typically provided with multiple electrical heating elements—all mounted near the bottom of the tank. The theory behind this particular heating element placement is that the entire volume of water in the tank can be quickly heated using the full combined power of the multiple elements. This is a satisfactory procedure when a large volume of hot water is used. However, if only a small water draw is taken, all the elements will fire and temperature overshoot can occur as the power is being applied at a very high rate. Additionally, the full power consumption is used whether a very small amount of water or a very large amount of water is being drawn from the tank. AS is well known, this results in an undesirably high electrical load factor in low water draw situations.

As can readily be seen from the foregoing, it would be desirable to provide an electric water heater in which these heating problems, limitations and disadvantages commonly associated with electric water heaters of conventional construction are eliminated or at least substantially reduced. It is to this goal that the present Invention is directed.

SUMMARY OF THE INVENTION

In carrying out principles of the present invention, in accordance with a preferred embodiment thereof, liquid heating apparatus is provided which is representatively in the form of an electric water heater. The water heater has a tank adapted to hold a quantity of water to be heated, the tank having a plurality of contiguous vertical zones of unequal volumes. A vertically spaced plurality of unequal wattage electrical heating structures extends Into the tank, with each electrical heating structure serving a different one of the zones. The electrical heating structures are sized in a manner such that they provide the zones with substantially equal heating wattage densities.

Representatively, the heating structures are individually controlled, and each heating structure is an Individual electrical resistance type immersion heating element. Alternatively, each heating structure could be defined by a closely grouped plurality of individual heating elements. In a first representative embodiment of the water heater the tank zones comprise a top zone contiguous with a bottom zone and having a volume smaller than the volume of the bottom zone, and the electrical heating structures comprise a top electrical heating structure serving the top zone and having a first wattage, and a bottom electrical heating structure serving the bottom zone and having a second wattage, the ratio of the first wattage to the second wattage being substantially identical to the ratio of the volume of the top zone to the volume of the bottom zone.

In a second representative embodiment of the water heater the tank zones comprise a top zone contiguous with a bottom zone and having a volume larger than the volume of the bottom zone, and the electrical heating structures comprise a top electrical heating structure serving the top zone and having a first wattage, and a bottom electrical heating structure serving the bottom zone and having a second wattage, the ratio of the first wattage to the second wattage being substantially Identical to the ratio of the volume of the top zone to the volume of the bottom zone. In a third representative embodiment of the water heater, the tank has at least three contiguous vertical zones of unequal volumes, each being served by a different one of the unequal wattage electrical heating structures.

The equal wattage density heating system incorporated in these representative electric water heater embodiments provides them with a variety of advantages over conventionally configured electrical water heaters, such advantages Including Increased water heating efficiency, a substantial reduction in undesirable temperature overshoot, and a desirable lowering of electrical load factors.

DETAILED DESCRIPTION

Figure 1:
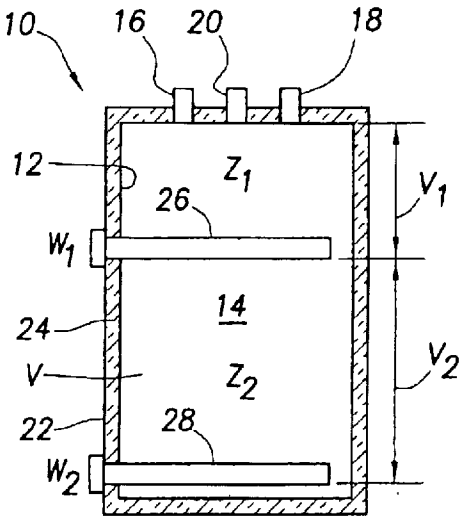

Schematically depicted in cross-section in FIG. 1 is an electric liquid heating apparatus, representatively an electric water heater 10, which embodies principles of the present Invention. The water heater 10 has a vertical, representatively cylindrical tank portion 12 in which a quantity of pressurized water 14 to be heated is stored, the tank 12 having a total interior volume V. Extending upwardly from the upper end of the tank 12, and communicating with its interior, are the usual cold water inlet, hot water outlet and temperature and pressure relief fittings 16,18,20. Extending outwardly around the tank 12 is a jacket structure 22 that forms around the tank 12 a cavity which Is filled with a suitable insulation material 24.

According to a key feature of the present invention, the water heater 10 is provided with a specially designed equal wattage density electric heating system used to heat the water 14 in the tank 12 for on-demand delivery therefrom to various plumbing fixtures such as, for example, sinks, showers, dishwashers and the like. With continuing reference to FIG. 1, the heating system comprises a vertically spaced plurality (representatively two in number) of electrical resistance type immersion heating structures 26,28 which horizontally project into the interior of the tank 12. Heating structures 26,28 are representatively single electric heating elements, but could each alternatively be a closely grouped plurality of Individual elements if desired.

The upper electrical heating element 26 serves and is positioned at the bottom of an upper tank water zone $Z_1$ having a volume $V_1$, while the lower electrical heating element 28 serves and is positioned at the bottom of a bottom tank water zone $Z_2$ having a volume $V_2$ which is representatively twice as great as the volume $V_1$. Upper heating element 26 has a heating wattage $W_1$ which is half of the heating wattage $W_2$ of the bottom heating element 28. Thus, according to a key aspect of the present invention, the heating system incorporated in the water heater 10 provides each of the unequal volume water zones $Z_1$ and $Z_2$ with equal heating wattage densities (e.g., watts/gallon) using unequal wattage heating elements.

For example, if tank 12 is a 60 gallon tank, the upper water zone $Z_1$ would have 20 gallons therein and the lower water zone $Z_2$ would have 40 gallons therein. If the upper heating element wattage $W_1$ is 3000 watts (3 kw), then the bottom heating element wattage $W_2$ would be 6000 watts (6 kW). Accordingly, the wattage/gallon value in zone $Z_1$ would be 3000 watts/20 gallons=150 watts/gallon, and the wattage/gallon value in zone $Z_2$ would be 6000 watts/40 gallons=150 watts/gallon. Thus, the heating wattage densities In the unequal volume tank water zones $Z_1$ and $Z_2$, achieved using the unequal wattage electrical heating elements 26 and 28, would be equal. Representatively, each of the Individual heating elements 26,28 is controlled by its own thermostat (not illustrated).

In the electric water heater 10 just described, the unit will only use the power required to heat the amount of water needed. For example, if only a small hot water draw is made, only the bottom heating element 28 will be energized. AS more water is drawn, the upper heating element 26 can be energized. The water heater 10 still has the total heating capacity of the two elements 26 and 28 when needed, but will adjust when this total wattage capacity is not needed. This desirably reduces the power consumption of the unit, and electrical load factor, thereby making the unit more energy efficient while at the same time substantially preventing undesirable temperature overshoot during small water draw conditions. The representative element arrangement and relative sizing shown in the electric water heater 10 is advantageous in applications wherein frequent short water draws are anticipated.

Figure 2:
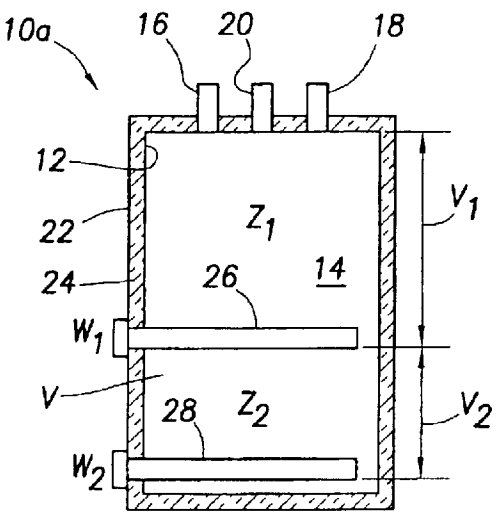

An alternate embodiment 10*a* of the previously described electric water heater 10 is schematically depicted in FIG. 2. Water heater 10*a* is similar to the previously described water heater 10 with the exception that the volume $V_1$ of the upper water zone $Z_1$ is representatively twice as large as the volume $V_2$ of the bottom water zone $Z_2$. Accordingly, the wattage $W_1$ of the upper heating element 26 is twice the wattage $W_2$ of the bottom heating element 28. As in the case of the previously described electric water heater 10, the volumes $V_1$,$V_2$ of water in zones $Z_1$,$Z_2$ thus have equal heating wattage densities. This representative element arrangement is particularly advantageous in short draw/bad water applications, and serves to lengthen element life.

Figure 3:
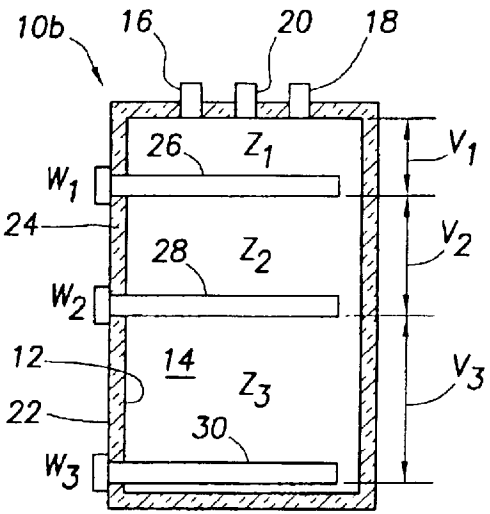
FIGS. 1–3 are schematic cross-sectional views through representative electric water heaters incorporating equal wattage density heating systems embodying principles of the present invention.

Of course, an electric water heater embodying principles of the present invention may have more than the two heating elements representatively illustrated in FIGS. 1 and 2. For example, the alternate electric water heater embodiment 10*b* schematically depicted in cross-section in FIG. 3 is representatively provided with three electric heating elements—an upper heating element 26 serving and positioned at the bottom of upper tank water zone $Z_1$, a vertically intermediate heating element 28 serving and positioned at the bottom of vertically intermediate tank water zone $Z_2$, and a bottom heating element 30 serving and positioned at the bottom of the bottom tank water zone $Z_3$.

The volume $V_2$ of the Intermediate tank water zone $Z_2$ is twice the volume $V_1$ of the upper tank water zone $Z_1$, and the volume $V_3$ of the bottom tank water zone $Z_3$ is twice the volume $V_2$ of the intermediate tank water zone $Z_2$. Accordingly, to provide the water zones $Z_1$,$Z_2$,$Z_3$ with equal wattage/gallon heating densities the wattage $W_2$ of the intermediate heating element 28 is twice the wattage $W_1$ of the upper heating element 26, and the wattage $W_3$ of the bottom heating element 30 is twice the wattage $W_2$ of the intermediate heating element 28.

While the present invention has been representatively illustrated and described herein as being incorporated in an electric water heater, it will readily be appreciated by those of skill in this particular art that principles of the present Invention could also be advantageously incorporated in other types of liquid heating devices if desired, and are not limited to water heaters. Additionally, while the individual electric heating structures shown herein have representatively been described as being individually controlled by, for example, separate thermostats, it will also be readily appreciated by those of skill In this particular art that in multi-element applications various individual electrical elements could be grouped for control purposes without departing from principles of the present invention.

The foregoing detailed description is to be clearly understood as being given by way of illustration and example only, the spirit and scope of the present invention being limited solely by the appended claims.

What is claimed is:

1. Liquid heating apparatus comprising:

a tank adapted to store therein a quantity of liquid to be heated, said tank having a plurality of contiguous vertical zones of unequal volumes; and a vertically spaced plurality of unequal wattage electrical heating structures extending into said tank, each electrical heating structure serving a different one of said zones, said electrical heating structures providing said zones with substantially equal heating wattage densities.

2. The liquid heating apparatus of claim 1 wherein:

said liquid heating apparatus is an electric water heater.

3. The liquid heating apparatus of claim 1 wherein:

said electric heating structures are individually controlled.

4. The liquid heating apparatus of claim 1 wherein:

each of said electrical heating structures is an individual electrical resistance type immersion heating element.

5. The liquid heating apparatus of claim 1 wherein:

said zones comprise a top zone contiguous with a bottom zone and having a volume smaller than the volume of said bottom zone, and said electrical heating structures comprise a top electrical heating structure serving said top zone and having a first wattage, and a bottom electrical heating structure serving said bottom zone and having a second wattage, the ratio of said first wattage to said second wattage being substantially identical to the ratio of the volume of said top zone to the volume of said bottom zone.

6. The liquid heating apparatus of claim 1 wherein:

said zones comprise a top zone contiguous with a bottom zone and having a volume larger than the volume of said bottom zone, and said electrical heating structures comprise a top electrical heating structure serving said top zone and having a first wattage, and a bottom electrical heating structure serving said bottom zone and having a second wattage, the ratio of said first wattage to said second wattage being substantially Identical to the ratio of the volume of said top zone to the volume of said bottom zone.

7. The liquid heating apparatus of claim 1 wherein:

said tank has at least three contiguous vertical zones of unequal volumes each being served by a different one of said electrical heating structures.

8. An electric water heater comprising:

a tank adapted to store therein a quantity of water to be heated, said tank having a plurality of contiguous vertical zones of unequal volumes;

an insulating jacket structure surrounding said tank; and a vertically spaced apart plurality of unequal wattage electrical heating structures horizontally projecting into the interior of said tank, each of said electrical heating structures extending along a bottom portion of and serving a different one of said zones, said electrical heating structures being sized to provide said zones with substantially equal heating wattage densities.

9. The electric water heater of claim 8 wherein:

said electrical heating structures are individually controlled.

10. The electric water heater of claim 8 wherein:

each of said electrical heating structures is an individual electrical resistance type immersion heating element.

11. The electric water heater of claim 8 wherein:

said zones comprise a top zone contiguous with a bottom zone and having a volume smaller than the volume of said bottom zone, and said electrical heating structures comprise a top electrical heating structure serving said top zone and having a first wattage, and a bottom electrical heating structure serving said bottom zone and having a second wattage, the ratio of said first wattage to said second wattage being substantially identical to the ratio of the volume of said top zone to the volume of said bottom zone.

12. The electric water heater of claim 8 wherein:

said zones comprise a top zone contiguous with a bottom zone and having a volume larger than the volume of said bottom zone, and said electrical heating structures comprise a top electrical heating structure serving said top zone and having a first wattage, and a bottom electrical heating structure serving said bottom zone and having a second wattage, the ratio of said first wattage to said second wattage being substantially identical to the ratio of the volume of said top zone to the volume of said bottom zone.

13. The electric water heater of claim 8 wherein:

said tank has at least three contiguous vertical zones of unequal volumes each being served by a different one of said electrical heating structures.

14. An electric water heater comprising a water storage tank having unequal volume interior zones respectively served by spaced apart unequal wattage electrical heating structures extending into the interior of the tank and providing said zones with substantially equal heating wattage densities.

15. The electric water heater of claim 14 wherein:

said unequal volume interior zones are contiguous vertical zones, and said unequal wattage electrical heating structures extend horizontally Into the interior of said tank.

* * * * *